United States Patent [19]

Villanyi et al.

[11] Patent Number: 4,928,647

[45] Date of Patent: May 29, 1990

[54] DUAL ACTING-DOUBLE BREAKOVER THROTTLE LEVER

[75] Inventors: Tibor J. Villanyi, Columbus; Kevin W. Westerson, Nashville, both of Ind.

[73] Assignee: Cummins Engine Company, Inc., Columbus, Ind.

[21] Appl. No.: 430,064

[22] Filed: Nov. 1, 1989

Related U.S. Application Data

[63] Continuation of Ser. No. 301,057, Jan. 25, 1989, abandoned.

[51] Int. Cl.[5] ..... F02D 11/04

[52] U.S. Cl. ..... 123/400; 74/513; 74/526; 123/198 DB; 251/279

[58] Field of Search ..... 123/198 D, 198 DB, 396, 123/397, 400; 74/482, 513, 519, 526; 251/279; 261/65

[56] References Cited

U.S. PATENT DOCUMENTS

| | | | |
|---|---|---|---|
| 3,698,372 | 10/1972 | Eshelman et al. | 123/198 DB |
| 3,699,943 | 10/1972 | Eshelman | 123/198 DB |
| 3,760,786 | 9/1973 | Marsh | 123/198 DB |
| 4,232,572 | 11/1980 | Ross et al. | 74/859 |

FOREIGN PATENT DOCUMENTS

| | | | |
|---|---|---|---|
| 2168427 | 6/1986 | United Kingdom | 123/396 |

*Primary Examiner*—Tony M. Argenbright

*Attorney, Agent, or Firm*—Sixbey, Friedman, Leedom & Ferguson

[57] ABSTRACT

A throttle lever assembly for an internal combustion engine including a reliable substantially failure-proof dual acting—double breakover throttle lever is provided to maintain control over engine throttling in the event of certain types of failure of the vehicle throttle control or related structures. The throttle lever assembly is operatively positioned between an operator-actuated throttle control and the engine fuel supply system. A throttle link lever mounted for pivotal movement relative to the throttle lever is actuated by the throttle control to cause the throttle lever to rotate a throttle shaft between preset full throttle and idle positions. The throttle lever and the link lever include integrally formed tabs which hold a coiled torsion spring positioned to resist breakover, thereby normally maintaining the assembly in an axially aligned operating position. Double breakover stops formed integrally on the link lever are provided to limit the breakover travel of the link lever to predetermined limits by positively contacting the throttle shaft in the event that the breakover mechanism is activated.

12 Claims, 4 Drawing Sheets

DUAL ACTING-DOUBLE BREAKOVER THROTTLE LEVER

This application is a continuation of Ser. No. 301,057, filed Jan. 25, 1989 now abandoned.

TECHNICAL FIELD

The present invention relates generally to throttle levers and specifically to a heavy duty throttle lever having a dual acting—double breakover capability that enhances the reliability of the throttle lever.

BACKGROUND ART

Throttle operating devices have long been employed in automotive and other vehicular internal combustion engines. These operating devices typically include a throttle lever attached to a throttle shaft and operatively connected to an associated throttle control linkage. The throttle control linkage is operatively connected to a foot-operated throttle pedal or "accelerator" or to another type of operator-actuated throttle control element within the vehicle's passenger compartment. This permits the operator to control the action of a fuel supply system, such as a fuel injection system or throttle valve through the throttle control linkage and associated throttle lever simply by pressing down or releasing the throttle pedal or by moving the throttle control element.

Throttle levers are normally arranged to move between two positions: an idle position wherein sufficient fuel is supplied to the engine so that it will run at a predetermined idling speed, and a full throttle position wherein a maximum amount of fuel is supplied to the engine. The idle and full throttle positions are normally defined by adjustable stops. When the accelerator is fully depressed or the throttle control element is fully advanced, the fuel supply control is in a full throttle position, and the engine is capable of running at a high speed. A return spring is typically used to bias the throttle lever to the setting required to maintain a preset engine idle speed when pressure on the throttle pedal is released or when the throttle control is fully retracted.

Various structures have been proposed to insure control over engine throttling and to avoid the creation of an "uncontrolled" engine wherein the operator loses control over the position of the throttle shaft. One circumstance which can overstress the throttle lever and potentially lead to loss of throttle shaft control is where the throttle shaft encounters a stop while continued advancing force is applied to the throttle lever through the throttle control linkage. Typically a "breakover" mechanism is provided in situations of this sort to protect the throttle lever against such excessive force. The throttle lever breakover capability will be activated when, for example, a vehicle driver continues to exert force on an accelerator pedal or throttle control element after the throttle shaft has reached its full throttle position.

Two part throttle levers, one part of which is pivotally mounted with respect to the other to form a lever link, are normally used to provide the breakover function. The lever link is able to move or "break over" independently of the throttle lever when conditions require breakover capability. A torsion spring is typically provided on the throttle lever to urge the lever link toward its normal position and to return the lever link to its normal position upon release of the breakover causing force. Some type of stop structure may also be provided to limit breakover travel. For example, in U.S. Pat. No. 3,760,786 to Marsh, a throttle return system is disclosed, including a two part lever and a coiled safety spring, which returns a throttle valve to the desired idle setting in the event of a failure of either the throttle return spring or the associated throttle control linkage. A stop structure on one of the lever sections prevents travel of this lever section in the event of a failure of the safety spring. However, this stop structure also holds one end of the coiled safety spring. Consequently, the stop is under constant pressure from the spring and is, therefore, susceptible to breakage. If the stop breaks, it can no longer hold the safety spring, which, in turn, can no longer provide the safety function it was intended to provide.

One known throttle lever design includes a one way breakover mechanism to permit over travel of the throttle linkage when the throttle shaft reaches its full throttle position. This known design includes a torsion spring for biasing the link lever toward its normal operating position and for transmitting the spring biasing force to the link lever. A stop pin, mounted on the link lever, is arranged to be engaged by one end of the torsion spring and to form a stop to define the normal operating position of the link lever relative to the throttle lever. This throttle lever design has some limitations, however. It can be installed by the end user in a way that may overstress the throttle lever torsion spring and cause it to break. As in the design disclosed in the Marsh patent, the stop pin holds the spring and is subject to the same constant stresses which under certain conditions can lead to premature breakage of the stop pin. Breakage of the stop pin results not only in the loss of spring function but can also result in loss of control by a human operator over the position of the throttle shaft.

Finally, current throttle lever designs are often subject to corrosion from the engine environment. Corrosion of either the spring or the stop pins, tabs or other breakover limit structures may ultimately result in the loss of function of these structures. Consequently, the throttle lever, throttle lever link, torsion spring stops and associated structures must currently be specially treated for corrosion resistance to forestall their failure. Such treatment, however, increases the cost of manufacturing these engine components and, in the end, may not be a guarantee against their failure.

The prior art, therefore, has failed to provide a reliable, heavy duty throttle lever assembly for an internal combustion engine including substantially failure-proof structure capable of performing a double breakover function to maintain throttle control in the event of a failure of the throttle lever torsion spring or any of the associated throttle lever linkage structures.

SUMMARY OF THE INVENTION

It is, therefore, a primary object of the present invention to overcome the disadvantages of the prior art and to provide a substantially failure-proof dual action—double breakover throttle lever assembly capable of reliably controlling throttle function in heavy duty internal combustion engine applications.

It is a still further object of the present invention to provide a throttle lever assembly formed of a minimum number of component parts which function synergistically to provide substantially failure-proof reliable control over the engine throttling function.

It is another object of the present invention to provide a dual acting—double breakover throttle lever assembly that discourages installation by the end user in a way that overstresses the throttle lever torsion spring.

It is a further object of the present invention to provide a dual acting—double breakover throttle lever assembly that is more nearly immune to the deleterious effects of corrosion.

It is yet another object of the present invention to provide a throttle lever assembly design including integrally formed stop means to limit the travel of a lever link relative to the throttle lever in the event of a failure of the throttle lever torsion spring or any of the associated torsion spring mounting structures.

Still another object of the present invention is to provide a throttle lever assembly for operating a rotatable throttle shaft between idle and full throttle positions including a link lever and means for affording a first breakover function beyond the full throttle position of the throttle shaft and a second breakover function in the return direction past the idle position of the throttle shaft wherein stop means are provided to limit the rotational displacement of the link lever relative to the throttle lever and further wherein spring biasing means are provided separate from the stop means to exert force on the lever link to return it to its non-breakover position.

The aforesaid objects are achieved by providing a throttle lever assembly for an internal combustion engine fuel system having a throttle shaft rotatable between an idle position and a full throttle position wherein the throttle lever assembly includes a throttle lever connected to the throttle shaft to move the shaft between the idle position and the full throttle position in response to movement of a throttle control. A throttle link means operatively connects the throttle lever and the throttle control to limit the degree of force that may be applied to the throttle lever means when the throttle shaft reaches either the idle or full throttle positions. The throttle link means includes a link lever pivotally connected to the throttle lever and a spring biasing means for urging the link lever toward a normal operating position relative to the throttle lever. Throttle link stop means limit the rotational displacement of the link lever relative to the throttle lever independently of the spring biasing means. The limited displacement permits continued control over the throttle shaft by the throttle operator even when the spring biasing means ceases to function. The throttle link stop means include a first stop surface formed on the link lever near the throttle shaft and is positioned to engage the throttle shaft to define a first breakover limit position when the link lever is rotated in a first direction. The throttle link stop means further includes a second stop surface on the link lever positioned to engage the throttle shaft to define a second breakover limit position when the link lever is rotated in a second direction opposite to the first direction. The spring biasing means is mounted on the throttle lever and engages tabs on the the link lever and throttle lever that are entirely separate from the throttle link stop means.

Additional objects and advantages will be apparent from an examination of the following description, claims and drawings.

DESCRIPTION OF THE PREFERRED EMBODIMENTS

Figure 2:
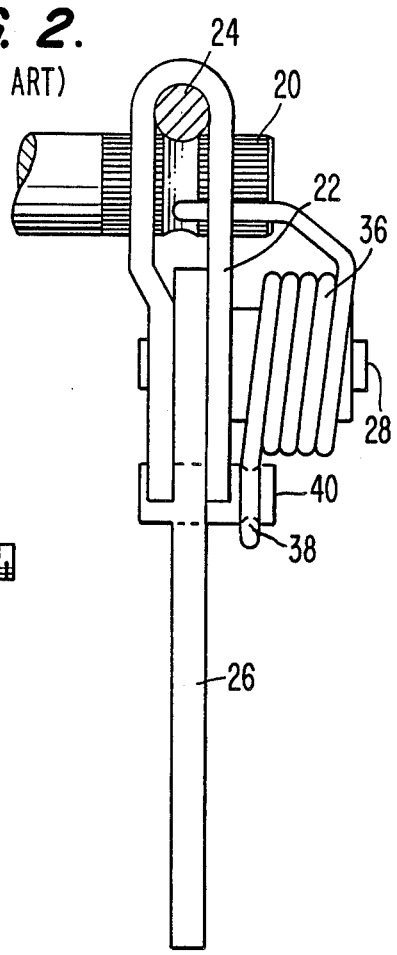
FIG. 2. (PRIOR ART)
FIG. 2 is a front elevational view of the throttle lever assembly of FIG. 1.

For a more complete understanding of the subject invention, reference will first be made to the prior art assembly illustrated in FIGS. 1 and 2. In particular, FIG. 1 discloses a known type of internal combustion engine throttling system which includes a throttle shaft 20 rotatably mounted within a throttle sleeve (not illustrated) contained within the housing of the engine fuel pump 12. As the throttle shaft 20 rotates within the throttle sleeve, fuel ports (not illustrated) in both structures move from (1) an idle condition in which the ports are substantially misaligned to cause only minimal fuel flow into the engine into (2) a full throttle condition in which the ports are substantially aligned to cause maximum fuel flow into the engine. The throttle shaft 20 includes a stop element 18 mounted thereon for rotation with the throttle shaft. Stop element 18 is designed to limit the rotation of the throttle shaft between an adjustable full throttle position wherein the ports are substantially fully aligned and maximum fuel flow is possible and an adjustable idle position, wherein the ports are substantially misaligned and only a small quantity of fuel can flow through the ports. The precise limits of rotation of the throttle shaft can be set by adjusting threaded stops 14 and 16, respectively, provided on the fuel pump housing 12. A throttle lever 22 is mounted on the throttle shaft 20 to rotate the throttle shaft 20 in response to forces exerted on the throttle lever 22 by the engine throttle control (i.e., an accelerator pedal, not illustrated) and throttle return spring 34. The throttle lever 22 is attached to the throttle shaft 20 by a nut and bolt assembly 24 so that rotation of the throttle lever 22 rotates the throttle shaft 20 between the full throttle and idle positions. When the throttle control is fully advanced, a throttle linkage member 32, connected between the throttle control and the throttle lever 22, causes the throttle lever 22 to move the throttle shaft 20 to the full throttle position. When the throttle control is released, the throttle return spring 34 then causes the throttle lever 22 to move the throttle shaft 20 to the preset idle position.

Figure 1:
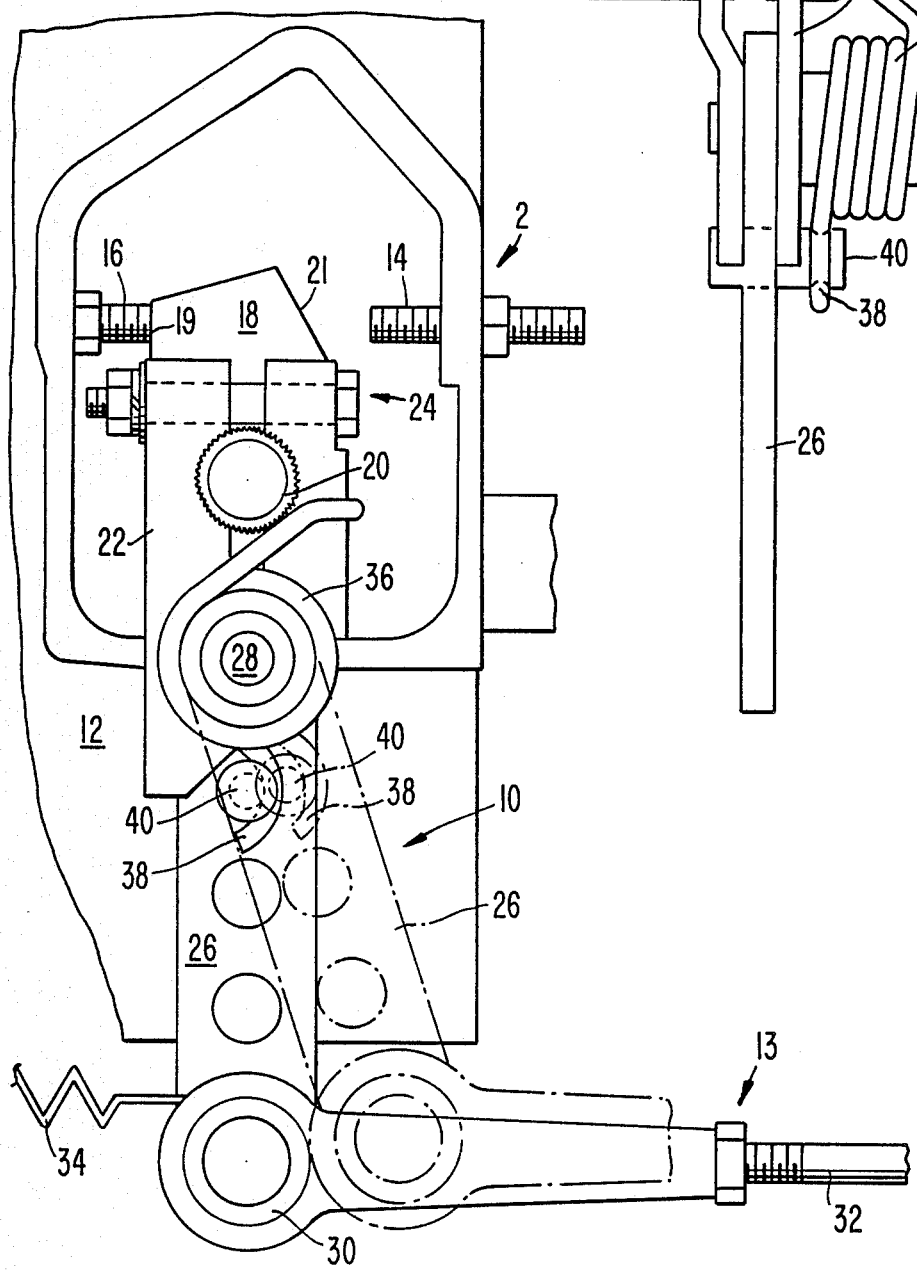
FIG. 1. (PRIOR ART)
FIG. 1 is a side elevational view of a prior art throttle lever assembly mounted on a fuel pump.

As can be understood by considering FIG. 1, adjustment in the position of stop 16 will cause throttle shaft 20 to assume a different full throttle position. Unless precautions are taken, a situation could arise in which continued application of force by a human operator on the throttle control could result in potential damage to the lever assembly. In an effort to avoid this problem, it is known in the prior art to provide a breakover mechanism operating in the full throttle position. The breakover mechanism includes a link lever 26 pivotally connected at one end to the throttle lever 22 by pivot pin 28. The other end of the throttle link lever 26 is attached a connector 30 which is, in turn, connected to a linkage member 32. The linkage member 32 provides the operative connection between the throttle link lever 26 and the throttle control (not shown). In addition to providing the attachment point for the connector 30, this end of the throttle link lever 26 is also connected to the vehicle throttle return spring 34. The throttle return spring 34 returns the throttle shaft 20 from the full throttle position shown in FIG. 1 to the idle position (not shown), wherein side 21 of the stop element 18 contacts the idle adjustment screw 14.

A torsion spring 36 is coiled around the pivot pin 28. One end 38 of the spring 36 engages a stop pin 40, which is attached to the throttle link lever 26. The stop pin 40 also functions to define the normal operating relationship of the throttle and link levers and to transmit force from the return spring to the throttle shaft 20 through the link lever 26 and throttle lever 27. The breakover mechanism allows adjustment in the full throttle position without creating the possibility that excessive force will be applied to the throttle lever.

One breakover position the throttle link lever 26 can assume is shown in dashed lines in FIG. 1. The throttle shaft 20 is in the full throttle position; however, the link lever 26 has rotated out of alignment with the throttle lever 22. The breakover mechanism allows the throttle shaft stop element 18 to move until it contacts the full throttle fuel adjusting screw 16. The throttle link lever 26 is capable of continued pivotal movement independent of the movement of the throttle shaft 20. This movement will not affect the fueling, and the throttle shaft 20 will remain in the position shown in FIG. 1 without any increase in fueling. The torsion spring 36 is coiled and positioned on the throttle lever assembly to urge the link lever 26 back into the normal position whenever the human operator causes the throttle control to return toward the idle position. The breakover mechanism, thus, allows adjustment in the full throttle position without creating the possibility that excessive force can be applied to the throttle lever.

The drawbacks of the prior art throttle lever assembly design shown in FIGS. 1 and 2 lie in the arrangement of the torsion spring 36 relative to the stop pin 40. Spring 36 is coiled to bias throttle link lever 26 toward the position shown in solid lines in FIG. 1. Moreover, end 38 of the spring 36 engages stop pin 40 and, consequently, the stop pin 40 is constantly subjected to the force applied by the spring 36. Stop pin 40 also operates to define the limit of return rotation of link lever 26 about pivot pin 28. Should pin 40 break due to corrosion and/or overstress, the throttle link lever 26 can still move, but spring 36 becomes ineffective and loss of control over throttling could result. If spring 36 is ineffective to bias the link lever 26 toward substantial alignment with throttle lever 22, the human operator will have no effective capability to control the position of throttle shaft 20. As noted above, the return spring 34 can still return the throttle shaft to the idle position, only if the stop pin 40 remains intact.

Further, if the stop pin 40 does not break, but simply falls out, the torsion spring 36 will no longer be held in place and may also fall out. Again, the throttle link lever 26 will pivot, but its movement will have no predictable effect on the movement of the throttle shaft.

The throttle lever assembly of the present invention, illustrated in FIGS. 3–8, overcomes these problems. The present throttle lever assembly provides dual acting, double breakover elements that are formed integrally with the components of the throttle lever assembly. Moreover, all of the components of the assembly are preferably made of stainless steel so that corrosion, which is a common cause of the failure of currently available throttle lever assemblies, is not a problem.

Figure 3:
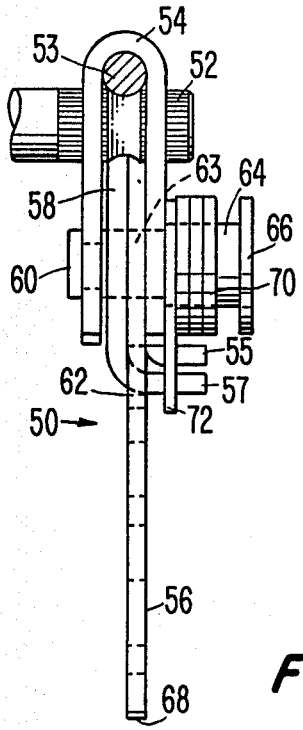
FIG. 3 is a front elevational view of a throttle lever assembly designed in accordance with the present invention.

Referring to FIG. 3, the assembly of the present invention 50 is mounted on a throttle shaft 52 of the type described above and includes a U-shaped throttle lever 54 mounted on the throttle shaft by a nut and bolt assembly 53. One leg of the throttle lever 54 terminates in an integrally formed projection or tab 55 which extends substantially prependicularly to one surface of the throttle lever 54.

Figure 6:
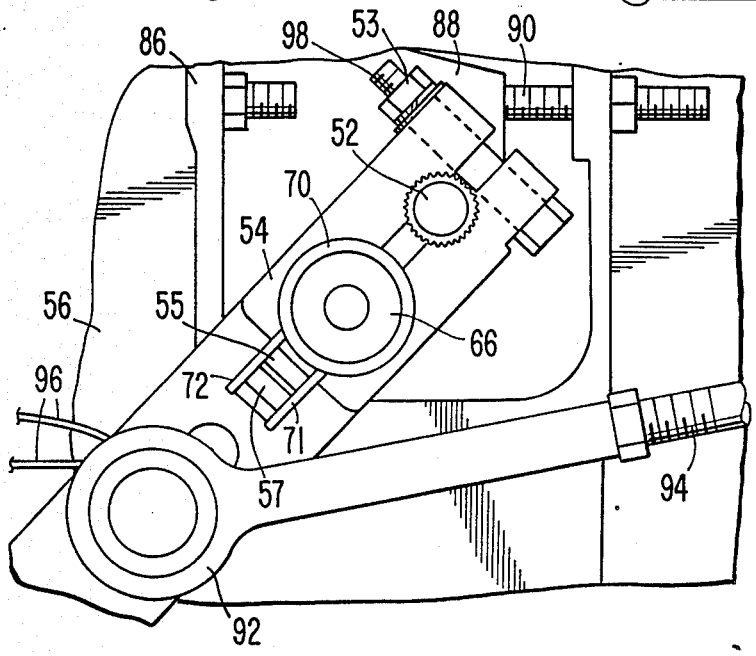
FIG. 6 is a side view of the throttle lever assembly of the present invention mounted on a fuel pump with the link lever in the normal operating position.
Figure 7:
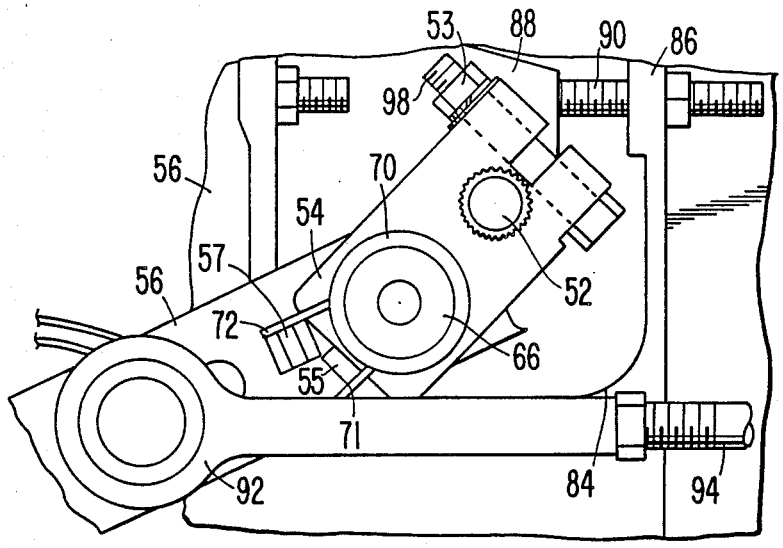
FIG. 7 is a side view of the present throttle lever assembly mounted on a fuel pump with the link lever in a first breakover position.
Figure 8:
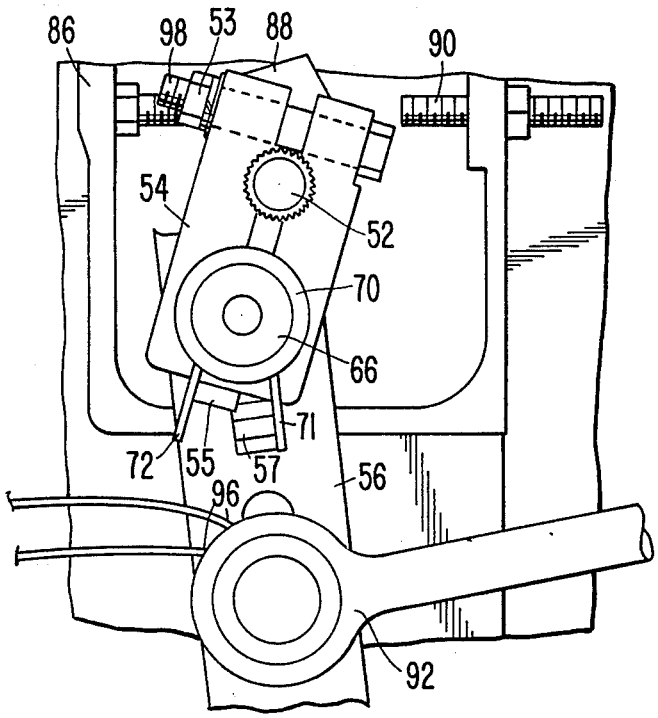
FIG. 8 is a side view of the present throttle lever assembly mounted on a fuel pump with the link lever in a second breakover position.

A throttle link lever 56 and a link spacer 58 are pivotally secured together between the legs of the throttle lever by means of a rivet 60. The link lever 56 is flat and significantly longer than link spacer 58. The link spacer 58 terminates in a projection or tab 57 that extends outwardly of the surface of the link spacer 58 and through an opening 62 in the link lever 56 so that it is substantially parallel to tab 55. The link spacer 58 is used to move the link lever 56 relative to the throttle lever 54, as will be described hereinbelow. Rivet 60 is formed as a projection from a pivot pin 63 having a larger diameter outer section 64 and an end cap 66. Pivot pin 63 mounts the link lever 56 and the link spacer 58 for pivotal movement relative to the throttle lever 54. The "sandwiching" of the link lever and link spacer within the legs of the throttle lever 54 and the securing of the link lever 56 and link spacer 58 permanently with rivet 60 has been found to provide maximum support to the moving link against side loading forces. This also causes the link lever 56 and link spacer 58 to pivot in unity about the throttle lever pivot pin 63 relative to the throttle lever 54 in a manner which will be described in detail hereinbelow. As in the prior art throttle lever assembly of FIGS. 1 and 2 and as shown in FIGS. 6–8, the terminus 68 of the throttle link lever 58 is connected through a suitable connector linkage (not shown) to the vehicle throttle control (not shown) and to the throttle return spring (not shown).

A torsion spring 70 is coiled about the throttle lever pivot pin outer section 64 between the end cap 66 and one leg of throttle lever 54 to bias the throttle lever 54, link lever 56 and link spacer 58 so that they are axially aligned in a breakover resist or normal operating position. The ends 71 and 72 of the spring 70 engage stop tabs 55 and 57, thereby tending to urge the throttle lever 54, the link lever 56 and the link spacer 58 toward a normal operating position wherein these structures are substantially aligned, as shown in FIGS. 3, 4 and 6.

As noted above, one leg of the throttle lever 54 terminates in an integrally formed projection or stop tab 55. This tab is stationary and does not move relative to pivot pin 63, whereas tab 57 on the link spacer 58 is movable with link lever 56 relative to stop tab 55.

Figure 4:
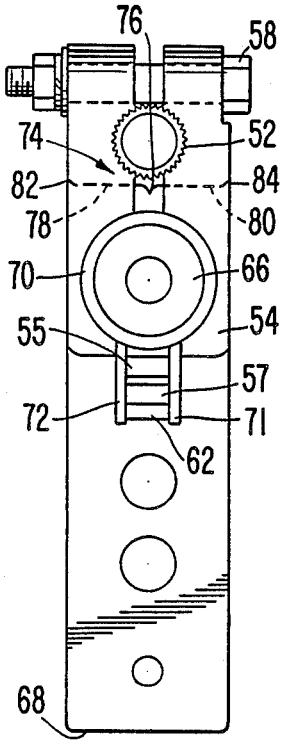
FIG. 4 is a side elevational view of the throttle lever assembly of the present invention.
Figure 5B:
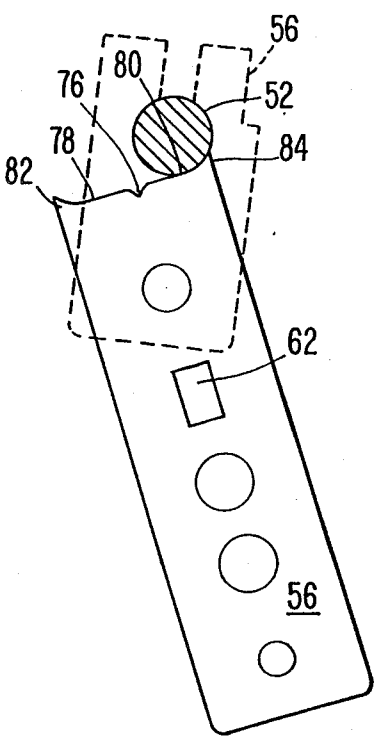
FIG. 5*b* illustrates the orientation of the throttle link relative to the throttle lever when the throttle link has reached the limit of its breakover position in the full throttle direction.
Figure 5A:
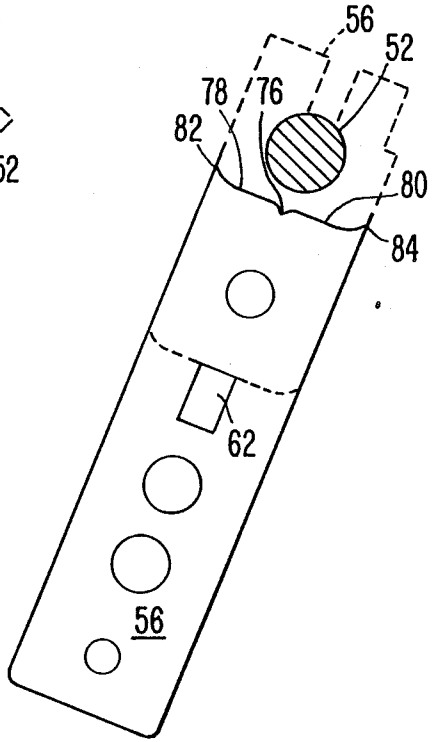
FIG. 5*a* illustrates the normal operating orientation of the throttle link relative to the throttle lever.
Figure 5C:
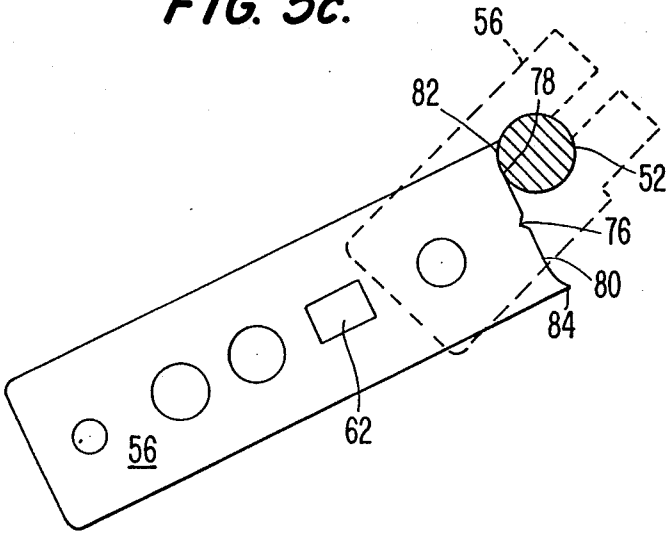
FIG. 5*c* illustrates the orientation of the throttle link relating to the throttle lever when the throttle link has reached the limit of its breakover position in the idle direction.

FIGS. 4 and 5 illustrate in more detail the additional features of the throttle lever assembly 5 and, in particular, of link lever 56 that provide the unique dual action-double breakover function of the present invention. The end 74 of link lever 56 opposite the terminus 68 has a configuration specifically designed to limit the extent of the movement of the link lever relative to the throttle shaft 52 in a manner to be explained in detail in connection with FIGS. *5a–c*. The end 74 of the link lever 56 includes a central notch 76 which functions as a breakover limit mark. On each side of the central notch are curved surface 78 and 80, each of which forms an integral breakover stop 82 and 84. Because breakover stops 82 and 84 are formed integrally with the link lever 56, they are not subject to malfunctions should any part of spring 70 or tabs 55 or 57 become inoperable.

FIGS. *5a*, *5b* and *5c* illustrate the manner in which the stops 82 and 84 limit the breakover travel of throttle link lever 56 (illustrated in dashed lines). The notch 76 facilitates the proper setting of the breakover travel limit. This is done by moving the link lever 56 longitudinally along its axis either toward or away from the throttle shaft 52. The link spacer 58 can be employed to move the link lever 56 as required for the proper setting. Since the link lever 56 and spacer 58 are secured together, movement of the stop tab 57 in the opening 62 will also move the link lever 56. The correct breakover setting is generally reached when the notch 76 can no longer be seen behind the throttle lever 54. The breakover zone may be set to limit the link lever lateral travel anywhere from 0 degrees to about 22 degrees from the longitudinal axis of the link lever 56. In most circumstances, it will be desirable to set the limit of breakover travel such that the breakover limit is typically not reached even when the throttle lever is in its idle or full throttle position so long as the spring biasing mechanism is functioning properly. FIGS. *5a*, *5b* and *5c* show the maximum breakover travel zone of about 22 degrees relative to the throttle shaft 52 in either direction from notch 76.

The link lever 56 is shown in FIG. *5a* aligned in the normal operating position. In this orientation of link lever 56, breakover stops 82 and 84 do not contact the throttle shaft 52. However, should spring 70 fail for any reason the link lever 56 is limited in the rotational distance it can travel in either direction. The double curved configuration of the end 74 of the link lever 56 will stop the travel of the link lever. In particular, as illustrated in FIG. *5b*, rotation of link lever 26 in the counterclockwise direction will cause stop 84 to contact throttle shaft 52 and prevent the link lever 56 from traveling further. If the link lever travels in the opposite direction, as illustrated in FIG. *5c*, the opposite stop 82 will contact the throttle shaft, thereby limiting travel in this direction as well. Forming the surfaces of stops 82 and 84 with a radius of curvature that approximates that of the throttle shaft insures that a substantial portion of each surface and not just a contact line will contact with the throttle shaft, thereby providing a stronger, more positive contact and further reducing the likelihood of breakage. Moreover, since the stops 82 and 84 can contact the throttle shaft during engine operation even when the spring 70 is fully operative, they prevent the spring from being overstressed during normal operation of the throttle assembly.

The throttle lever assembly 50 of the present invention functions to rotate the throttle shaft 52 between full throttle and idle positions in response to movement of the engine throttle control as described above in connection with FIG. 1. However, the present throttle lever provides a greatly improved, substantially failure-proof breakover mechanism that effectively prevents the occurrence of a "uncontrolled" throttle. As shown in FIGS. 3 and 4, the link lever 56 includes integrally formed breakover stop tabs 82 and 84 which curve outwardly from a central notch 76. The breakover stops 82 and 84 will make contact with the throttle shaft only upon reaching the limit of travel in either breakover direction. Thus, excessive rotational displacement in the breakover mode is avoided. Moreover, the breakover function will continue even if the torsion spring breaks or tabs 55 and 57 become inoperative for any reason.

FIGS. 6, 7 and 8 illustrate, respectively, the normal operating, idle breakover, and full throttle breakover positions of the present throttle lever assembly.

FIG. 6 shows the throttle lever 54 and the link lever 56 axially aligned in a normal operating idle position as the assembly is mounted on a fuel pump 86. A stop element 88 mounted on the throttle shaft 52 contacts the fuel pump idle adjustment screw 90. A connector 92 is secured to link lever 56 and to a linkage element 94, which is operatively connected to a throttle control (not shown). Throttle return springs 96 provide return force tending to move the throttle shaft to its idle position. The ends 71,72 of torsion spring 70 engage stop tabs 55,57, which are substantially parallel to each other. FIG. 6 illustrates the relative positions occupied by all of the components in the present throttle lever assembly when the throttle shaft is in the preset idle position and a predetermined minimum amount of fuel flow is allowed.

FIG. 7 illustrates the present throttle lever assembly in a idle breakover position. The throttle stop element 88 contacts the idle adjustment screw 90, thereby holding the throttle shaft 52 in the preset idle position. However, due to linkage or return spring operation, sufficient force has been exerted on the lever link 56 to cause the lever assembly to "break over" and move out of axial alignment with the throttle lever 54. The stationary stop tab 55 on the throttle lever 54 continues to engage end 71 of spring 70. However, stop tab 57 on the link spacer moves with the link lever, thereby moving spring end 72 and tensioning the spring 70. Because the maximum breakover movement of link lever 56 is limited by the link breakover stop 82, the link lever 56 and, therefore, the stop tab 55 can move only that distance allowed by the travel of the breakover stop 82 until it contacts the throttle shaft 52. Consequently, the maximum possible tension on spring 70 caused by the idle breakover is limited.

FIG. 8 illustrates the present throttle lever assembly in a full throttle breakover position. The throttle stop 88 contacts the full throttle adjustment screw 98 to allow maximum fuel flow through the throttle shaft and fuel pump. The throttle lever maintains the throttle shaft in this position while the link lever is able to "break over" limited only by the breakover stop 84 which contacts the throttle shaft. Stop tab 55 is moved out of alignment with stationary stop tab 57 to tension end 72 of spring 70. Spring end 71 contacts stop tab 57.

As noted, tension on the spring 70 is limited since the extent of the movement of the movable stop tab 55 is substantially the same as that of the link lever 56. If the breakover stop did not limit this movement, the tab 55 might move the spring ends 71 and 72 far enough to place the spring 70 under undesirably high stress.

In the unlikely event that the torsion spring 70 is disconnected or breaks, the breakover stop 84 on the link lever 56 will still cause the throttle shaft 52 to respond to movement of the throttle control. Further, the vehicle return springs 96 (FIG. 8) are also able to return the throttle lever 56 to the idle position because the breakover stop 82 on the link lever 56 will contact the throttle shaft 52, thereby limiting the rotational movement of the lever link 56 relative to the throttle lever 54 and causing the throttle lever 54 to rotate the throttle shaft to its idle position.

Unlike the separate stop pin 40 of the prior art throttle lever assembly of FIGS. 1 and 2, the integrally formed stop tabs or projections 55 and 57 of the present invention are more likely to remain in place and will not fall out of the throttle lever link. Additionally, these stop tabs 55 and 57 are not as susceptible to breakage from the tension placed on them by spring 70. The spring 70 can be coiled to a desired torsion strength before installation on the pivot pin section 64. Because the relative movement of the stop tabs 55 and 57 holding the ends of the springs is limited by the breakover travel of the throttle lever link as discussed above, the additional stress placed on the spring by this movement is held within predetermined maximum limits. Consequently, overstressing of the torsion spring 70 should not occur with the present invention, which further enhances the reliability of this throttle lever assembly.

The present throttle lever assembly, moreover, requires only five separate components to achieve its virtually failure-proof control of engine throttling. In contrast, the currently available throttle levers include many more components and, as discussed above, do not provide the virtually failure proof measure of control over engine throttling achieved by the present design.

Because, as stated above, all of the individual components of throttle lever assembly 50 are fabricated from stainless steel, corrosion of these components in the hostile environment encountered in an internal combustion engine will not occur. Consequently, their useful life is long, which further increases the reliability of the dual acting—double breakover throttle lever of the present invention. Bench tests have demonstrated, moreover, that the throttle lever assembly of the present invention has a life cycle in excess of one million miles.

Industrial Applicability

The dual acting—double breakover throttle lever assembly of the present invention will find its primary application as a component of an internal combustion engine in which reliable maximum control over throttling function is desired.

We claim:

1. A throttle lever assembly for operating a throttle shaft adapted to control the flow of fuel to an internal combustion engine as the throttle shaft is moved between an idle position and a full throttle position in response to a throttle control, comprising (a) a throttle lever means adapted to be connected with the throttle shaft for moving the throttle shaft between the idle and the full throttle positions in response to movement of the throttle control;

(b) throttle link means connected to said throttle lever means and to the throttle control for limiting the degree of force which may be applied to said throttle lever means when the throttle shaft reaches at least one of said idle and full throttle positions, said throttle link means including a link lever pivotally connected to said throttle lever means, and (c) throttle link stop means for limiting the rotation of said link lever relative to said throttle lever means to a predetermined maximum first breakover position, said throttle link stop means including a first stop on said link lever positioned to engage the throttle shaft when said link lever reaches said first breakover position, whereby control of said throttle shaft may be continued by the throttle control even if said throttle link means malfunctions.

2. A throttle lever assembly as defined in claim 1, wherein said link lever is rotatable between a normal operating position and said first breakover position and further including a spring biasing means for biasing said link lever toward said normal operating position.

3. A throttle lever assembly as defined in claim 2, wherein said spring biasing means includes a spring having a pair of ends, said throttle lever means including a first spring end engaging portion for engaging one of said spring ends and said link lever includes a second spring end engaging portion for engaging the other of said spring ends, said first and second spring end engaging portion being separate from and independent of said throttle link stop means.

4. A throttle lever assembly as defined in claim 3, wherein said link lever is rotatable from said normal operating position to said first breakover position when rotated in one direction and is rotatable from said normal operating position to a second breakover position defined by said throttle link stop means when rotated in a second direction opposite said first direction, said throttle link stop means including a second stop portion on said link lever which is positioned to engage the throttle shaft when said link lever reaches said second breakover position.

5. A throttle lever assembly for operating a throttle shaft adapted to control the flow of fuel to an internal combustion engine as the throttle shaft is moved between an idle position and a full throttle position in response to a throttle control, comprising: p1 (a) a throttle lever means adapted to be connected with the throttle shaft for moving the throttle shaft between the idle and full throttle positions in response to movement of the throttle control;

(b) throttle link means connected to said throttle lever means and to the throttle control for limiting the degree of force which may be applied to said throttle lever means when the throttle shaft reaches at least one of s id idle and full throttle positions, said throttle link means including a link lever pivotally connected to said throttle lever means to move from a normal operating position to a first breakover position, (c) throttle link stop means for limiting the rotation of said link lever relative to said throttle lever means to a predetermined amount sufficiently small to permit continued control over the position of the throttle shaft by the throttle control, said throttle link stop means defining said first breakover position of said link lever; and (d) a spring biasing means for biasing said link lever toward said normal operating position, said spring biasing means including a spring having a pair of ends, wherein said throttle lever means includes a first spring end engaging portion for engaging one of said spring ends and said link lever includes a second spring end engaging portion for engaging the other of said spring ends, and said first and second spring end engaging portions are separate from and independent of said throttle link stop means.

6. The throttle lever assembly described in claim 5, wherein said throttle link stop means is formed integrally with said link lever and includes a stop surface for engaging the throttle shaft.

7. The throttle lever assembly of claim 6, wherein said throttle link means operates to limit force which may be applied to said throttle lever by the throttle control when the throttle shaft reaches both said idle position and for said full throttle position, said link lever includes a second stop portion for engaging the throttle shaft.

8. The throttle lever assembly described in claim 7, wherein said first and second stop positions includes curved stop surfaces each having a radius of curvature conforming approximately to the radius of curvature of said throttle shaft.

9. The throttle lever assembly described in claim 7, further including breakover limit indicating means formed on said link lever whereby the breakover travel limits of said throttle link means can be set.

10. The throttle lever assembly described in claim 9, wherein said link lever means includes a link spacer means secured to said link lever for supporting said second spring engaging portion and for moving said link lever to set said breakover travel limits.

11. The throttle lever assembly described in claim 10, wherein said link spacer means include a link spacer pivotally connected to said throttle lever for rotation about the same axis as said link lever.

12. The throttle lever assembly describes in claim 11, wherein said throttle lever includes a U-shaped member forming a pair of spaced legs for sandwiching said link lever and said link spacer, said throttle shaft being received in a slot cut into the bend of said U-shaped member, said stop surfaces of said link lever being adjustable positioned relative to the throttle shaft to adjust the rotational displacement of said link lever required to cause the limit of said breakover travel to be reached.

* * * * *